United States Patent [19]

Saita et al.

[11] Patent Number: 4,605,878

[45] Date of Patent: Aug. 12, 1986

[54] SUPPORTING DEVICE FOR AN ELECTRON BEAM LANDING POSITION SELECTING MASK OF A COLOR CATHODE RAY TUBE

[75] Inventors: Koji Saita, Kanagawa; Kenichi Kanehira; Tomohisa Uba, both of Tokyo, all of Japan

[73] Assignee: Sony Corporation, Tokyo, Japan

[21] Appl. No.: 613,384

[22] Filed: May 23, 1984

[30] Foreign Application Priority Data

May 31, 1983 [JP] Japan ..... 58-81901[U]

[51] Int. Cl.[4] ..... H01J 29/80

[52] U.S. Cl. ..... 313/406; 313/404

[58] Field of Search ..... 313/404, 406, 402, 407, 313/269

[56] References Cited

U.S. PATENT DOCUMENTS

| | | | |
|---|---|---|---|
| 3,335,479 | 8/1967 | Morrell | 313/406 |
| 3,358,170 | 12/1967 | Fiore | 313/404 |
| 3,370,194 | 2/1968 | Schwartz et al. | 313/404 |
| 4,333,033 | 6/1982 | Cordingley et al. | 313/406 |
| 4,495,437 | 1/1985 | Kume et al. | 313/407 |

*Primary Examiner*—Davis L. Willis
*Assistant Examiner*—William L. Oen
*Attorney, Agent, or Firm*—Hill, Van Santen, Steadman & Simpson

[57] ABSTRACT

A supporting device for an electron beam landing position selecting mask of a color cathode ray tube having an envelope, a color phosphor screen and an electron gun is disclosed which includes a metal stud pin arranged within the envelope and a spring member attached to the electron beam landing position selecting mask, the spring member being engaged with the metal stud pin so that the electron beam selecting mask is disposed in opposed relation to the color phosphor screen, the spring member having a polygonal engaging aperture bored therethrough at its end portion with which the metal stud pin is engaged wherein the stud pin contacts with the polygonal engaging aperture at three points to thereby settle the position of the electron beam selecting mask and the inner peripheral edge of the polygonal engaging aperture and the peripheral surface of the metal stud pin are fixed together at least at one point other than the three points by welding.

2 Claims, 7 Drawing Figures

SUPPORTING DEVICE FOR AN ELECTRON BEAM LANDING POSITION SELECTING MASK OF A COLOR CATHODE RAY TUBE

BACKGROUND OF THE INVENTION

1. Field of the Invention

The present invention relates generally to a color cathode ray tube and more particularly to a supporting device for an electron beam selecting mask of a color cathode ray tube.

2. Description of the Prior Art

In a color cathode ray tube, as, for example, shown in FIG. 1 which is schematically a longitudinal cross-sectional view and FIG. 2 which is an inside rear view, an electron beam landing position selecting means 4 such as an aperture grille or a shadow mask is disposed in opposed relation to a color phosphor screen 3 formed on the inner surface of a panel portion 1*p* of a tube envelope 1 to allow an electron beam b (only one beam b is typically shown in FIG. 1) emitted from an electron gun 5 to land on the phosphor screen 3 at its corresponding color phosphor. Such electron beam selecting means 4 has a frame 6 which consists of opposing frame members 6*a* and 6*b* and left and right arms 6*c* and 6*d* which are supported therebetween at their both ends as, for example, shown in FIG. 3. On the front side of the opposing frame members 6*a* and 6*b* of the frame 6, namely, the end surface thereof facing to the color phosphor screen 3, a large number of metal bands 7 are arranged and stretched in parallel to each other between the adjacent metal bands 7. To the frame 6 of the electron beam selecting means 4 thus formed, are attached springs, for example, three springs 9*b*, 9*c* and 9*d* to dispose the frame 6, accordingly, the selecting means 4 inside the panel portion 1*p* of the tube envelope 1 in facing relation to the phosphor screen 3. The springs 9*b*, 9*c* and 9*d* are each formed by leaf springs and welded at their one end to, for example, the lower frame member 6*b* and the left and right arms 6*c* and 6*d* of the frame 6. Triangular engaging apertures 10 are respectively formed through the springs 9*b*, 9*c* and 9*d* at their free end portions and ceramic stud pins 11 fixed by fritting or the like on the inner surface of the skirt portion of the panel portion 1*p*, to which the frame member 6*b* and the arms 6*c* and 6*d* of the frame 6 are faced, are engaged into the engaging apertures 10 to settle the position of the frame 6.

Generally, such electron beam selecting means 4 is held to the tube envelope 1 by simply engaging the springs 9*b*, 9*c* and 9*d*, which are all fixed to the three sides of the frame 6 of the selecting means 4, namely, the lower frame member 6*b* and the left and right arms 6*c* and 6*d*, with the corresponding stud pins 11. In this case, the free ends of three members comprising the springs 9*b*, 9*c* and 9*d* are resiliently pressed against the corresponding stud pins 11 toward their base sides having large diameters, so that the respective sides of each triangular engaging aperture 10 are caused to contact with the peripheral surface of the corresponding stud pin 11 at three points, thus the selecting means 4 being held in a predetermined positional relation relative to the tube envelope 1.

With the color cathode ray tube having such structure or particularly color cathode ray tube having an adjusting mechanism such as a bimetal mechanism or the like for adjusting the fluctuation of bar height due to temperature change in connection with the electron beam selecting means, there is such a risk that when the engaged position of the spring 9 (9*b*, 9*c* and 9*d*) with the stud pin 11 is displaced by adjusting the bar height with the bimetal mechanism or is displaced by an external impact, engagement between the spring 9 and the stud pin 11 is disengaged or cannot be restored to a predetermined engaged position so that the positional relation between the phosphor screen 3 and the electron beam selecting means 4 is displaced thus color misregistration or the like being caused.

OBJECTS AND SUMMARY OF THE INVENTION

Accordingly, it is an object of the present invention to provide an improved supporting device for an electron beam landing position selecting mask of a color cathode ray tube.

Accordingly, it is an object of the present invention to provide a supporting device for an electron beam selecting mask of a color cathode ray tube which can prevent an electron beam selecting mask from being displaced in position by an external impact even when the color cathode ray tube employs a bimetal mechanism to adjust bar height in accordance with the temperature change.

It is a further object of the present invention to provide a supporting device for an electron beam selecting mask of a color cathode ray tube which can prevent the electron beam selecting mask from being disengaged from a tube envelope of the color cathode ray tube.

According to one aspect of the present invention, there is provided a supporting device for an electron beam selecting mask of a color cathode ray tube having an enevelope, a color phosphor screen and an electron gun comprising:

(a) a metal stud pin arranged within an envelope of the color cathode ray tube; and (b) a spring member attached to said electron beam selecting mask, said spring member being engaged with said metal stud pin so that said electron beam landing position selecting mask is disposed in opposed relation to said color phosphor screen, said spring member having a polygonal engaging aperture bored therethrough at its end portion with which said metal stud pin is engaged wherein said stud pin contacts with said polygonal engaging aperture at three points to thereby settle the position of said electron beam landing position selecting mask and the inner peripheral edge of said polygonal engaging aperture and the peripheral surface of said metal stud pin are fixed together at least at one point other than said three points by welding.

The other objects, features and advantages of the present invention will become apparent from the following description taken in conjunction with the accompanying drawings through which the like references designate the same elements and parts.

DESCRIPTION OF THE PREFERRED EMBODIMENT

Figure 1:
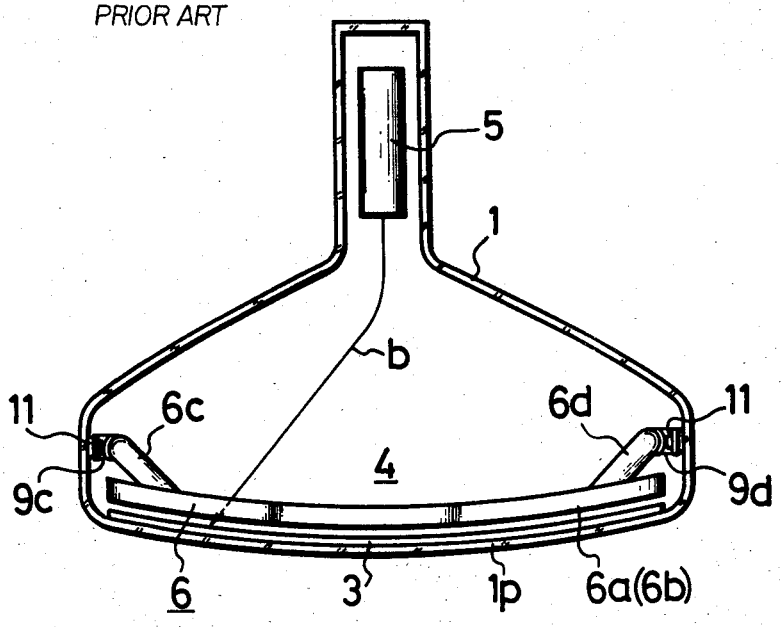
FIG. 1 PRIOR ART
FIGS. 1 and 2 are respectively, schematically, a plan cross-sectional view of a conventional color cathode ray tube and an inside rear view useful for explaining the present invention and an inside rear view thereof.
Figure 2:
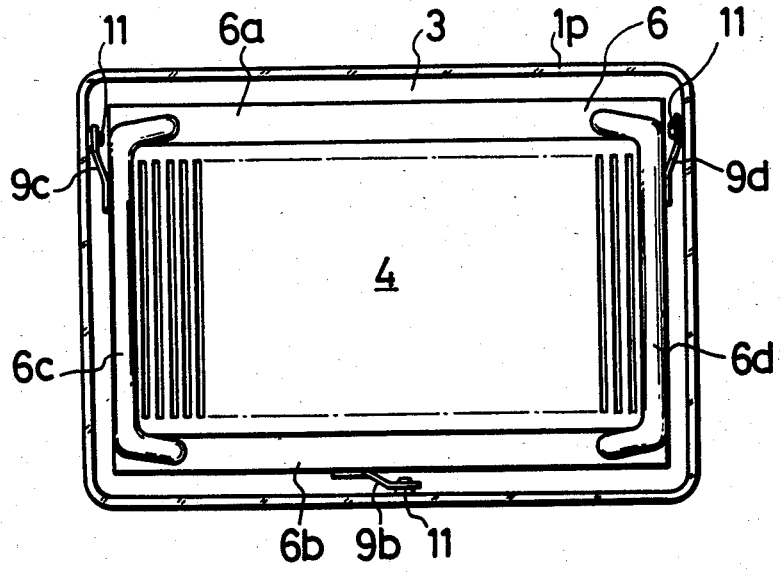
FIG. 2 PRIOR ART
Figure 3:
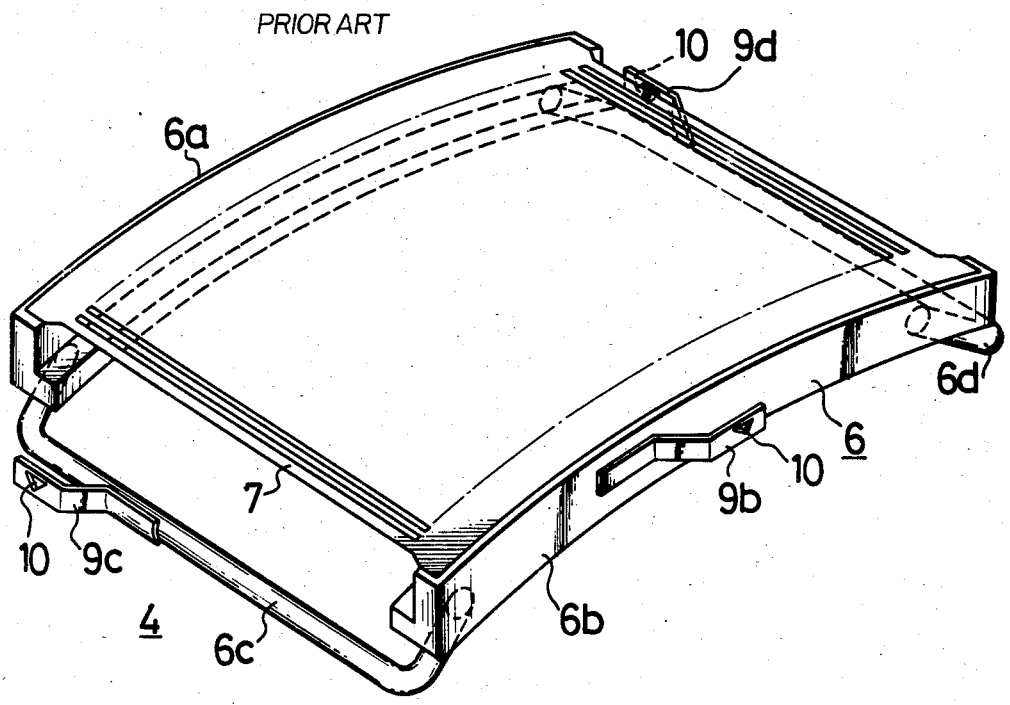
FIG. 3 PRIOR ART
FIG. 3 is an isometric view of an electron beam landing position selecting means used in the color cathode ray tube shown in FIG. 1.
Figure 4:
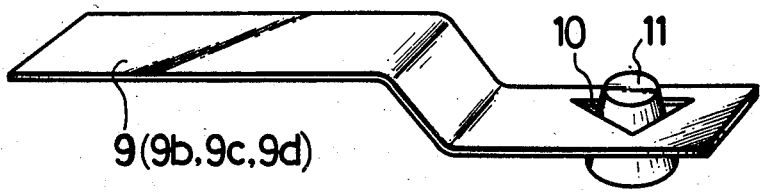
FIG. 4 PRIOR ART
FIG. 4 is an enlarged perspective view illustrating the engaged state of its spring with its stud pin.
Figure 5:
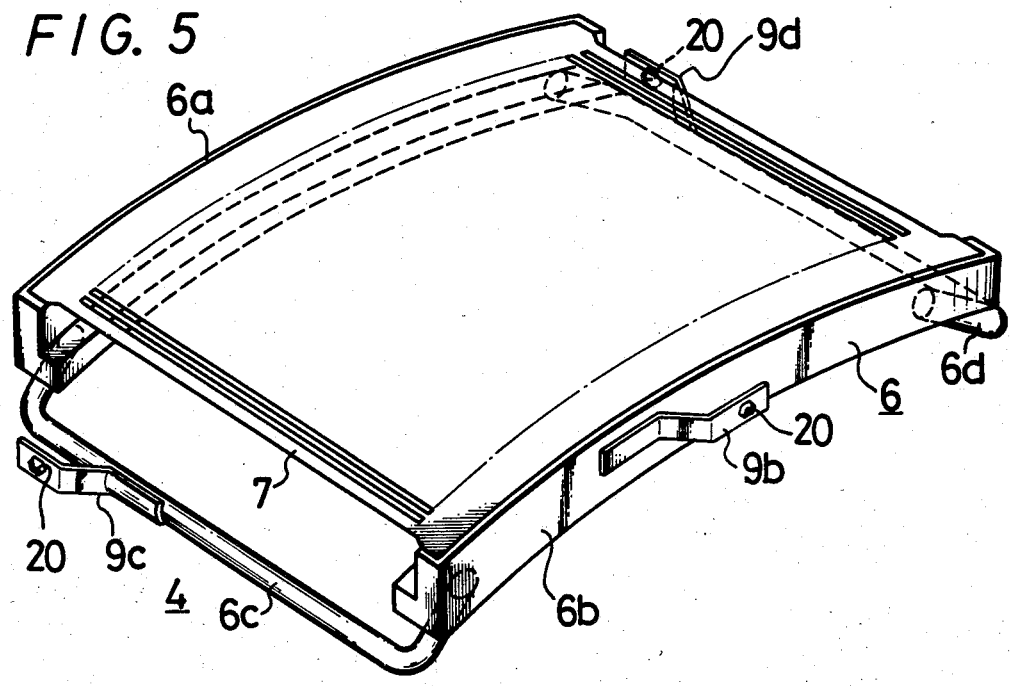
FIG. 5 is a perspective view of an embodiment of the supporting device for an electron beam landing position selecting mask of a color cathode ray tube according to the present invention.
Figure 6:
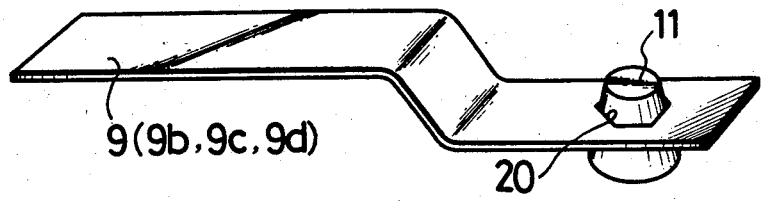
FIGS. 6 and 7 are respectively an enlarged perspective view and an enlarged plan view illustrating a relation between the spring and the metal stud pin used in the embodiment of the present invention shown in FIG. 5.
Figure 7:
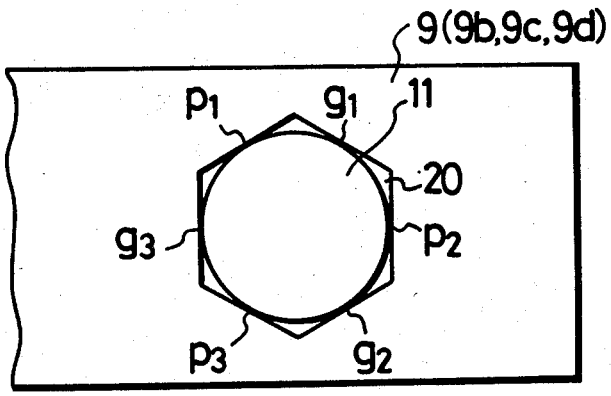

Now, an embodiment of the supporting device for an electron beam landing position selecting mask of a color cathode ray tube according to the present invention will hereinafter be described in detail with reference to FIGS. 5 to 7. In FIGS. 5 to 7, like parts corresponding to those in FIGS. 1 to 4 are marked with the same references and will not be described in detail. Also in this embodiment, as was seen in FIGS. 1 to 3, the electron beam selecting mask or means 4 is disposed in facing relation to the panel portion 1*p* of the tube envelope 1 on the inner surface of which is formed the phosphor screen 3 whereby the electron beam b emitted from the electron gun 5 disposed in the neck portion of the tube envelope 1 is caused to land on the corresponding color phosphor element. The electron beam selecting means 4, as shown in FIG. 5, has a frame 6 of the opposing upper and lower frame members 6*a* and 6*b* in the same way as in FIG. 3. The grid member is stretched between the frame sides 6*a* and 6*b*, on which a large number of bimetal bands 7, for example, are disposed with a predetermined spacing relative to each other to form slits.

Leaf springs 9*c*, 9*d* and 9*b* are welded to the arms 6*c* and 6*d* and, for example, the lower frame member 6*b* at each one end, and engaging apertures 20 are formed through the free ends of the springs 9*c*, 9*d* and 9*b* for engagement with respective stud pins 11 fixed on the inner wall surface of the panel portion 1*p* of the tube envelope 1. Particularly in this embodiment of the invention, the engaging aperture 20 is formed in a special shape as shown in FIGS. 6 and 7. That is, as shown in FIG. 7, the engaging aperture 20 is formed hexagonal with six straight line sides and equal included angles of 120°, but with alternate sides slightly shorter. The engaging aperture 20 is in contact with the frusto-conical stud pin 11 at three points $p_1$, $p_2$, $p_3$ on the longer sides of the hexagon. Thus the electron beam selecting means 4 is settled at the predetermined position of the panel 1*p* as if the aperture 20 were a triangle. The shape of hexagonal aperture is arranged so that predetermined spacing, small spacings $g_1$, $g_2$ and $g_3$ of, for example, 0.2 mm to 0.3 mm are provided between the peripheral surface of the stud pin 11 and the three shorter sides alternately with the three sides having the points $p_1$, $p_2$ and $p_3$.

The color phosphor screen 3 is formed on the inner surface of the panel 1*p* and finally the electron beam selecting means 4 is secured to the panel 1*p* in opposed relation to the phosphor screen 3. In accordance with the present invention, with the stud pins 11 engaged with the corresponding engaging apertures 20 of the springs 9 (9*b*, 9*c* and 9*d*) so as to contact with each engaging aperture 20 at three points $p_1$, $p_2$ and $p_3$, the springs 9 and the peripheral surface of the stud pins 11 are fixed together through the spaced portions $g_1$, $g_2$ and $g_3$ by bonding, such as spot welding. In other words, the small spacings $g_1$, $g_2$ and $g_3$ on these sides are formed so that spot welding is made possible thereat without contact between the aperture and stud before the welding, so that the stud pin 11 contacts the engaging aperture 20 only at three points $p_1$, $p_2$ and $p_3$, whereby stable positioning is effected.

While in the above embodiment each of the engaging apertures 20 is formed generally hexagonal with six straight line sides, the shape of the engaging aperture 20 is not limited to the hexagon but may be polygon having more than at least three sides or above, namely, more than three sides with contact with the stud pins 11 at three points generally opposing and one or more sides close to, but not contacting, the pins 11.

While in the embodiment shown, three welded points are provided, one or more welded points may be sufficient so that the number of sides of the engaging aperture 20 can be selected as desired.

As described above, according to the present invention, since the electron beam selecting means is disposed within the tube envelope 1 of the cathode ray tube by engaging the springs 9 with the metal stud pins 11 and the stud pin 11 contacts with the engaging aperture 20 of the spring 9 at three points $p_1$, $p_2$ and $p_3$ positioned with equal angular spacing, the positioning of the electron beam selecting means 4 is determined with accuracy.

Furthermore, since the springs 9 and the stud pins 11 are finally fixed together by welding, it is possible to surely prevent the spring 9 and the stud pin 11 from being disengaged from each other, even after positioning in the color cathode ray tube and while the bimetal mechanism or the like is operating to adjust the bar height which would otherwise be displaced by the rise of temperature in the electron beam selecting means 4, or by impact exerted from outside the tube.

The above description describes a preferred embodiment of the invention, but it will be apparent that modifications and variations could be effected by one skilled in the art without departing from the spirit or scope of the novel concepts of the invention, so that the scope of the invention should be determined by the appended claims only.

We claim as our invention:

1. A supporting device for an electron beam landing position selecting mask of a color cathode ray tube having an envelope, a color phosphor screen and an electron gun comprising:

(a) a plurality of conical shaped metal stud pins arranged within an envelope of the color cathode ray tube; and (b) a plurality of spring members attached to said electron beam landing position selecting mask, said spring members being engaged with said metal stud pins so that said electron beam selecting mask is disposed in opposed relation to said color phosphor screen, said spring members having a polygonal engaging aperture at their end portions with which said metal stud pins are engaged, wherein said stud pins contact with said polygonal engaging apertures at three generally opposed points to thereby determine the position of said electron beam selecting mask, the inner peripheral edge of said polygonal engaging aperture and a closely adjacent peripheral surface of said metal stud pins being welded together at at least one point other than said three contact points.

2. The structure of claim 1 wherein said polygonal apertures have six sides alternate ones of which are close to, but do not contact, said pin and wherein at least one of said non-contacting sides is welded to said pin.

* * * * *